US006615633B1

(12) United States Patent
Akashi et al.

(10) Patent No.: US 6,615,633 B1
(45) Date of Patent: Sep. 9, 2003

(54) METAL PLATENESS CONTROLLING METHOD AND DEVICE

(75) Inventors: Toru Akashi, Futtsu (JP); Motokazu Koreeda, Kitakyushu (JP); Seiji Arizumi, Oita (JP); Yoshihiro Serizawa, Futtsu (JP)

(73) Assignees: Nippon Steel Corporation, Tokyo (JP); Nittetsu Plant Designing Corporation, Fukuoka (JP)

( * ) Notice: Subject to any disclaimer, the term of this patent is extended or adjusted under 35 U.S.C. 154(b) by 0 days.

(21) Appl. No.: 09/889,614

(22) PCT Filed: Mar. 17, 2000

(86) PCT No.: PCT/JP00/08093

§ 371 (c)(1),
(2), (4) Date: Aug. 22, 2001

(87) PCT Pub. No.: WO01/36122

PCT Pub. Date: May 25, 2001

(30) Foreign Application Priority Data

Nov. 18, 1999 (JP) ..... 11-327684
Feb. 28, 2000 (JP) ..... 2000-050759

(51) Int. Cl.[7] ..... B21B 27/06

(52) U.S. Cl. ..... 72/200; 72/8.5; 72/11.3; 72/201; 72/342.5

(58) Field of Search ..... 72/8.5, 11.3, 12.2, 72/200, 201, 202, 342.5

(56) References Cited

U.S. PATENT DOCUMENTS 4,503,697 A * 3/1985 Tippins et al. ..... 72/202
4,745,786 A * 5/1988 Wakako et al. ..... 72/38
5,611,232 A * 3/1997 Rohde et al. ..... 72/202
5,651,281 A * 7/1997 Seidel ..... 72/11.8
5,755,128 A * 5/1998 Tippins et al. ..... 72/10.4
5,927,118 A * 7/1999 Minote et al. ..... 72/11.3
6,062,055 A * 5/2000 Bobig et al. ..... 72/201

FOREIGN PATENT DOCUMENTS

| | | | | |
|---|---|---|---|---|
| JP | 56-95404 | | 8/1981 | |
| JP | 57-97813 | * | 6/1982 | ..... 72/11.3 |
| JP | 62-93028 | | 4/1987 | |
| JP | 63-126608 | | 5/1988 | |
| JP | 3-175001 | | 7/1991 | |
| JP | 4-66271 | | 3/1992 | |
| JP | 5-228525 | | 9/1993 | |
| JP | 6-254616 | | 9/1994 | |
| JP | 6-269835 | | 9/1994 | |
| JP | 7-132307 | | 5/1995 | |
| JP | 8-71628 | | 3/1996 | |
| JP | 10-5868 | | 1/1998 | |
| JP | 11-29094 | | 10/1999 | |

* cited by examiner

*Primary Examiner*—Ed Tolan
(74) *Attorney, Agent, or Firm*—Kenyon & Kenyon

(57) ABSTRACT

The present invention provides a method to control the flatness of a metal sheet or plate by effectively preventing waviness from occurring at the edge portions of the sheet or plate when it is cooled to the room temperature after completing hot rolling, and an apparatus to carry out the method: and relates to a method to control the flatness of a metal sheet or plate by homogenizing the surface temperature distribution of the metal sheet or plate through; measuring the surface temperatures of the metal sheet or plate at the edge portions and the center portion across its width between two rolling stands of a tandem finishing mill, or at the entry to and/or the exit from a reversing finishing mill, or after completing hot rolling, or after hot leveling; controlling the heating temperatures of the edge portions and/or the center portion based on the measured surface temperatures; and then cooling the metal sheet or plate after completing the finishing rolling.

9 Claims, 4 Drawing Sheets

Fig.5(b')

METAL PLATENESS CONTROLLING METHOD AND DEVICE this application is a 35 USC 371 of Pct/JP00/08093 filed Mar. 17, 2000.

TECHNICAL FIELD

The present invention relates to a method and an apparatus to control the flatness of a metal sheet or plate through; heating the edge portions and/or the center portion of the metal sheet or plate, using a heating apparatus or heating apparatuses installed between two rolling stands of a tandem finishing mill, or at the entry to and/or the exit from a reversing finishing mill, or using a heating apparatus or heating apparatuses immediately after rolling; and successively cooling the sheet or plate after finish rolling: for eliminating edge waves occurring at the edge portions of the width direction and/or center waves occurring at the center portion of the width direction in a sheet or plate of metal such as steel, aluminum, titanium and the like result from temperature difference across its width before cooling.

BACKGROUND ART

Waviness (edge waves) of metal materials, especially that of steel materials, which becomes apparent when the materials are cooled at a cooling process after a rolling process, has been prevented conventionally through overcompensation of the waviness by forming moderate waviness at the width center (center waves or center buckles) at a hot rolling mill or a hot leveler after the rolling. However, waviness not corrected by this method has to be corrected separately by leveling work at a subsequent conditioning process.

Against this background, many methods to prevent the waviness of steel sheets or plates have been proposed. For instance, Japanese Unexamined Patent Publication No. H5-269527 proposes a method to control the flatness of a metal strip by: installing a tension leveler at a position where the cooling of the strip is finished but its coiling is not yet finished; installing a shape detection roll capable of measuring the transverse tension distribution of the strip at the position immediately before the final roll of the tension leveler; and changing the screw-down setting of the shape detection roll based on the metal strip flatness information detected by itself. As another example, Japanese Unexamined Patent Publication No. H10-263658 proposes a method to control the flatness of a metal strip by: calculating an elongation rate difference from flatness information given by a flatness gauge installed at the exit from a hot finishing mill and flatness information before coiling given by another flatness gauge installed at the entry to a coiler; and feeding the elongation difference information back to the roll bending control function of the hot finishing mill. Besides the above, Japanese Pat. No. 2792788 discloses an apparatus provided with a roller leveler and an edge heater installed between a roughing mill and a finishing mill for preventing the warping of the leading end of a strip.

The method to control the flatness of metal strips according to the Japanese Unexamined Patent Publications No. H5-269527 or No. H10-263658, however, uses the information of strip flatness or elongation strain difference as the basis of the flatness control, and neither of them does considers the information of the temperature distribution across the strip width. When a strip is cooled to near the room temperature during a rolling process, the transverse temperature distribution of the strip becomes even.

However, since most of the strips are coiled at high temperature to obtain prescribed material quality in normal rolling practice, the transverse temperature distribution tends to be such that the temperature of the edge portions is lower than that of the center portion and temperature difference is generated. For this reason, even if the elongation strain difference is once removed by the above methcds, the temperature difference at this stage remains as thermal stress when the strips are cooled to the room. temperature, and the flatness is not finally corrected. Also, the apparatus according to the Japanese Patent No. 2792788 cannot compensate for the temperature drop at the edge portions occurring during the finish rolling and therefore the improvement of flatness after cooling cannot be expected.

DISCLOSURE OF THE INVENTION

The object of the present invention, which solves the problems contingent with the above conventional technologies, is to provide a method and an apparatus to control flatness, capable of improving the flatness by preventing edge waves occurring at the edge portions and center waves in a metal sheet or plate from appearing after cooling. The gist of the present invention, therefore, is as follows:

(1) A method to control the flatness of a metal sheet or plate characterized by: measuring the surface temperatures of the metal sheet or plate at the edge portions and the center portion across its width after one or more rolling passes at a tandem or reversing finishing mill; controlling the heating temperatures of the edge portions and/or the center portion based on the measured surface temperatures; and then water-cooling and/or hot-leveling the metal sheet or plate.

(2) A method to control the flatness of a metal sheet or plate characterized by: measuring the surface temperatures of the metal sheet or plate at the edge portions and the center portion across its width between two rolling stands of a tandem finishing mill; controlling the heating temperatures of the edge portions and/or the center portion based on the measured surface temperatures; and then cooling the metal sheet or plate after the finish rolling.

(3) A method to control the flatness of a metal sheet or plate characterized by: measuring the surface temperatures of the metal sheet or plate at the edge portions and the center portion across its width at the entry to and/or the exit from a reversing finishing mill; controlling the hearing temperatures of the edge portions and/or the center portion based on the measured surface temperatures; and then cooling the metal sheet or plate after the finish rolling.

(4) A method to control the flatness of a metal sheet or plate characterized by: heating the edge portions and/or the center portion in the width of the metal sheet or plate after completing hot rolling; and then water-cooling and/or hot-leveling the metal sheet or plate.

(5) A method to control the flatness of a metal sheet or plate characterized by: hot-leveling the metal sheet or plate after completing hot rolling; heating the edge portions and/or the center portion in the width of the metal sheet or plate; and then leaving it to cool naturally in normal atmosphere or cooling it with water.

(6) A method to control the flatness of a metal sheet or plate according to the item (4) or (5), characterized in that the water-cooling of the metal sheet or plate is conducted on a run out table (ROT cooling) and that the metal sheet or plate is coiled after the ROT cooling.

(7) A method to control the flatness of a metal sheet or plate according to the item (4) or (5), characterized by leaving the metal sheet or plate to cool naturally in a normal atmosphere after subjecting it to the water cooling and/or the hot leveling.

(8) A method to control the flatness of a metal sheete or plate according to the item (4) or (5), characterized by: measuring the surface temperatures of the metal sheet or plate at the edge portions and/or the center portion across its width after completing hot rolling and before heating it; and then controlling the heating temperatures of the edge portions and/or the center portion based on the measured temperatures.

(9) A method to control the flatness of a metal sheet or plate according to the item (4) or (5), characterized by controlling the heating temperatures of the edge portions of the metal sheet or plate so that the difference between the surface temperature of each edge portion measured in the range of 50 to 200 mm as edge portion and that of its center portion becomes within ±50° C.

(10) A method to control the flatness of.a metal sheet or plate according to the item (4) or (5), characterized by controlling the heating temperature of the width center portion of the metal sheet or plate so that the difference between the average temperature of the width direction at the center portion of the metal sheet or plate and the temperature across the width, not exceeding the average temperature, becomes within ±10° C.

(11) An apparatus to control the flatness of a metal sheet or plate characterized by having: a tandem finishing mill; a means to measure the surface temperatures of the metal sheet or plate at the edge portions and the center portion across its width installed between two rolling stands of the tandem finishing mill; a means to heat the edge portions and/or the center portion in a manner to control the heating temperatures based on the measured surface temperatures; and a means to cool the metal sheet or plate at the exit from the finishing mill.

(12) An apparatus to control the flatness of a metal sheet or plate characterized by having: a reversing finishing mill; a means to measure the surface temperatures of the metal sheet or plate at the edge portions and the center portion across its width installed at the entry to and/or the exit from the reversing finishing mill; a means to heat the edge portions and/or the center portion in a manner to control the heating temperatures based on the measured surface temperatures; and a means to cool the metal sheet or plate at the exit from both the means to measure the surface temperatures and the finishing mill.

(13) An apparatus to control the flatness of a metal sheet or plate according to the item (11) or (12), characterized in that a means to heat the edge portions and/or the center portion of the metal sheet or plate is an induction heater, a laser irradiation heater, a plasma irradiation heater or a gas combustion heater.

(14) A method to control the flatness of a metal sheet or plate according to any one of the items (1) to (3), characterized by trimming the edge portions of the metal sheet or plate, in addition to heating the edge portions, using a laser irradiation heater.

(15) A method to control the flatness of a metal sheet or plate according to any one of the items (1) to (5), characterized by transferring the metal sheet or plate while holding it with a pair or two pairs of upper and lower pinch rolls after the leading end of the metal sheet or plate has left the hot finishing mill and passed through the pinch rolls.

(16) An apparatus to control the flatness of a metal sheet or plate characterized by having an edge heater and/or a center portion heater for the metal sheet or plate between a hot finishing mill and a water cooling apparatus and/or a hot Leveler.

(17) An apparatus to control the flatness of a metal sheet or plate characterized by having an edge heater and/or a center portion heater for the metal sheet or plate at the exit from a hot leveler, which is installed at the exit from a hot finishing mill.

(18) An apparatus to control the.flatness of a metal sheet or plate according to the item (16) or (17), characterized by having a controlled cooling apparatus at the exit from the edge heater and/or the center portion heater for the metal sheet or plate.

(19) An apparatus to control the flatness of a metal sheet or plate according to any one of the items (11) to (18), characterized by having an apparatus to measure the surface temperature of the metal sheet or plate installed between the hot finishing mill, and the edge heater and/or the center portion heater for the metal sheet or plate.

(20) An apparatus to control the flatness of a metal sheet or plate according to the item (11) or (12), characterized by having at least a pair of upper and lower pinch rolls between the hot finishing mill and the edge heater and/or the center portion heater for the metal sheet or plate.

Here, the temperature of an edge portion of a metal sheet or plate is defined as the surface temperature of the metal sheet or plate at a point in the range of 50 to 200 mm from the edge.

BEST MODE FOR CARRYING OUT THE INVENTION

The inventors of the present invention examined the mechanisms which deteriorate the flatness of metal sheets or plates and the measures used to improve the flatness in various ways. The principles of the present invention are described hereafter and the description is based on the drawings.

Figure 1:
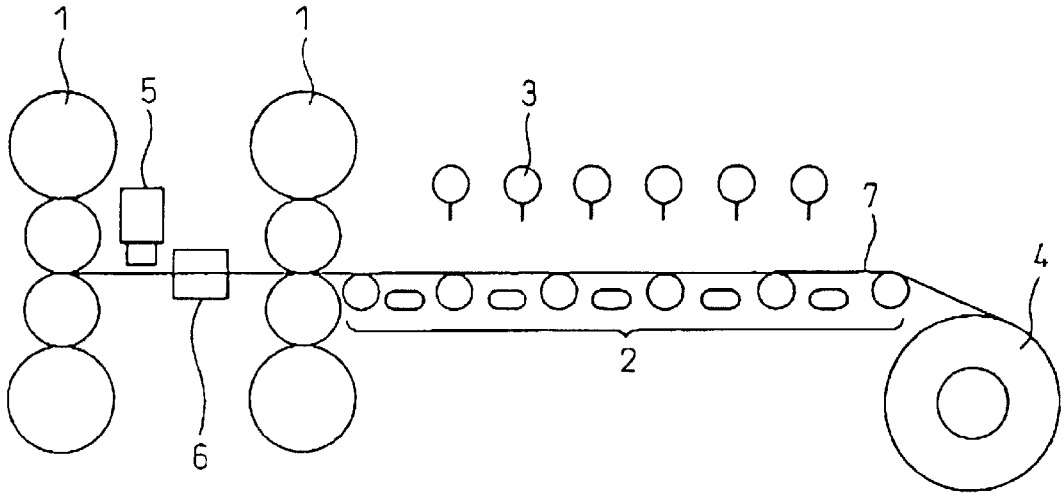
FIG. 1 is an illustration showing an outline of production processes where a tandem finishing mill is used, and an embodiment of the present invention.
Figure 2:
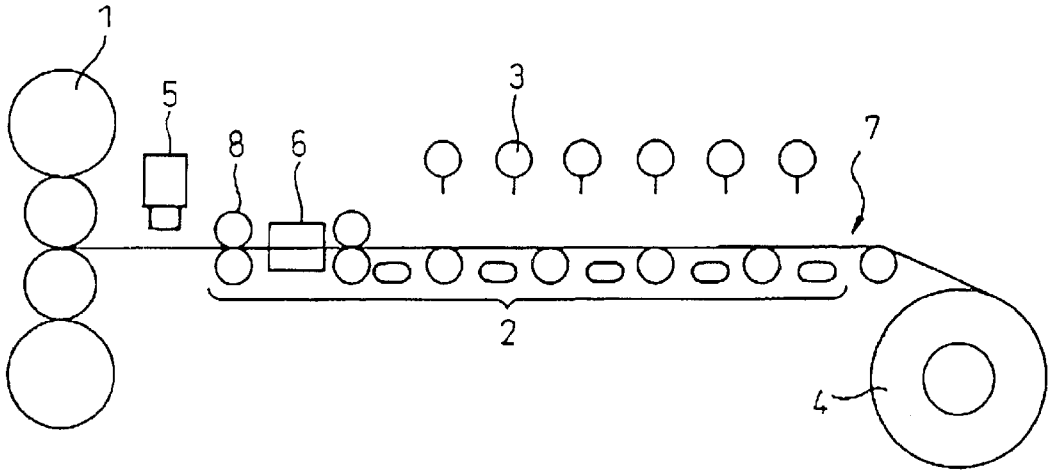
FIG. 2 is an illustration showing an outline of production processes of a hot-rolled steel sheet or plate, and an embodiment of the present invention.

The present inventors conducted a series of tests for the purpose of understanding the mechanisms which deteriorate the flatness in commercial production processes of hot-rolled steel sheets and plates. FIGS. 1 and 2 are schematic illustrations of finishing mills, and the facilities therefore, used in the production processes of hot-rolled steel sheets or plates. A steel sheet or plate is first rolled into a prescribed size at a finishing mill 1, transferred on a run out table (ROT) 2, cooled to a prescribed temperature by an ROT cooler 3 for the purpose of obtaining prescribed material quality, and then wound into a coil at a coiler 4.

The coiling temperature of a steel sheet or plate ranges from 100 to 750° C. depending on the material quality and, when the coil is cooled down to room temperature and unwound, there are cases that wavy deformations appear at either of its edges. This phenomenon called edge wave is the very flatness problem the present inventors are concerned about. It is the edge wave that becomes a problem with most hot-rolled steel sheets and plates. However, when slab edges are heated excessively caused by an operation condition of a reheating furnace and the temperature at the center portion of a steel sheet or plate before water cooling becomes markedly lower than the average temperature across the width, waviness at the center (center buckle) is generated. The present invention aims at preventing edge waves and center buckles which appear due to transverse temperature difference. The waviness may be caused by other reasons. When the shape of the mandrel of a coiler 4 or pinch rolls (PRs) is convex and coiling tension is abnormally large, the waviness may appear in the center portion rather than the edges. However, this type of waviness is out of the scope of the present invention.

Figure 3:
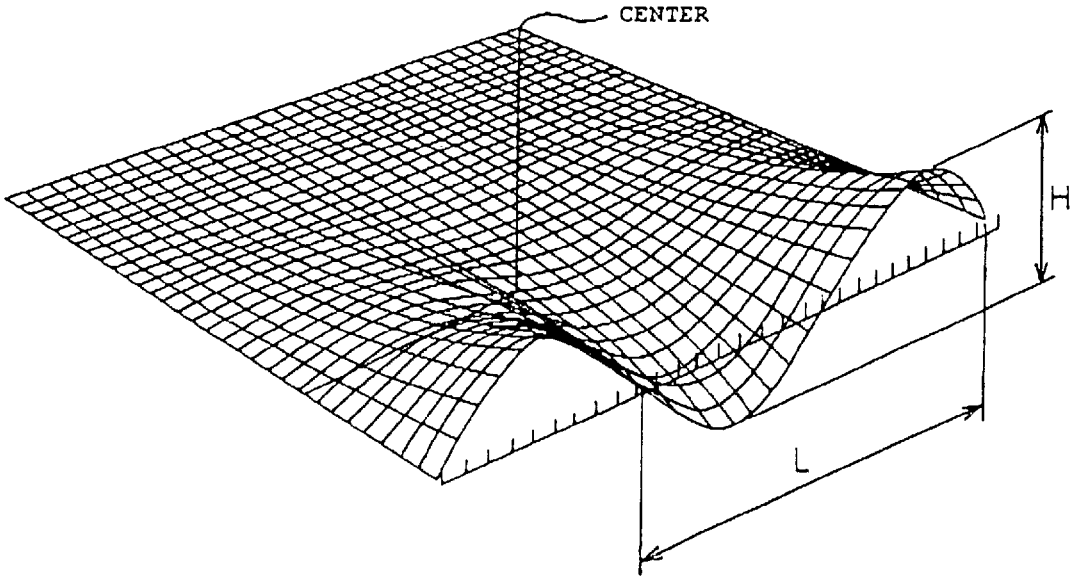
FIG. 3 is an illustration to explain the definition of the steepness of sheet/plate waves.
Figure 4:
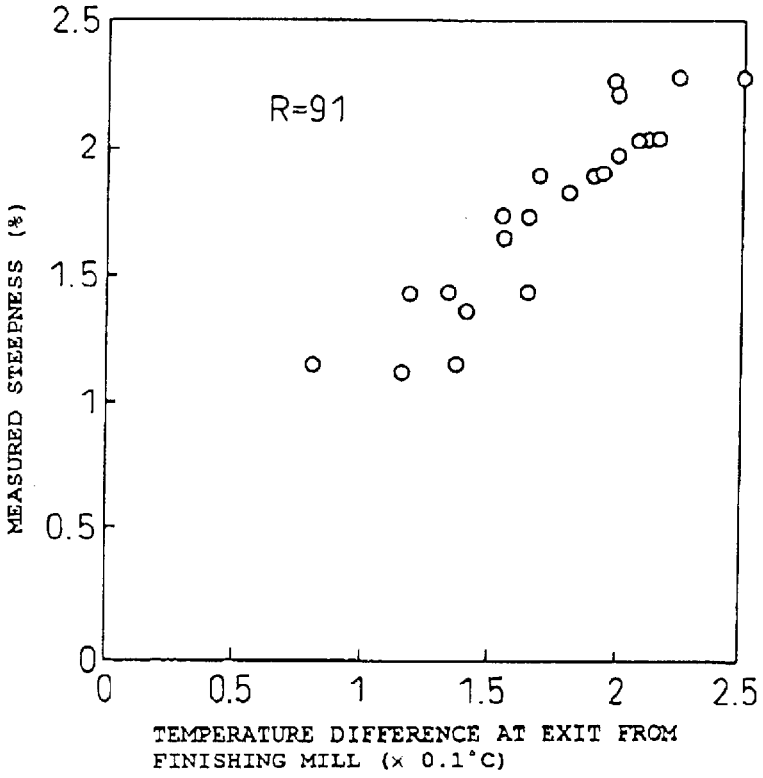
FIG. 4 is a graph showing the relationship between the temperature difference at the sheet/plate edges and the steepness, verifying the principles of the present invention.

FIG. 3 shows the definition of an edge wave. The steepness of a wave is expressed as the percentage figure of the edge wave height H divided by the pitch of the wave L, multiplied by 100.

The present inventors measured the temperatures of hot-rolled steel sheets of the same steel grade and size (2 mm in thickness and 1,200 mm in width) at the same measuring point (400 m from the coil center) using a pyrometer 5 capable of measuring the temperatures at the center and 20 mm from the both edges across the width, installed between two stands of a finishing mill or at the exit from a finishing mill, and analyzed the relationship between the flatness of the sheets after cooling and the surface temperature difference between the width center and 20 mm from each of the edges. As a result, they discovered that there was a strong correlation between the flatness of the steel sheets.and the surface temperature unevenness at the exit from the finishing mill, that the flatness of the sheets was predictable based on the surface temperature unevenness and, therefore, that flat steel sheets could be produced by heating the sheet edges before ROT cooling so as to homogenize the steel sheet temperatures across the width.

Figures 5A, 5B:
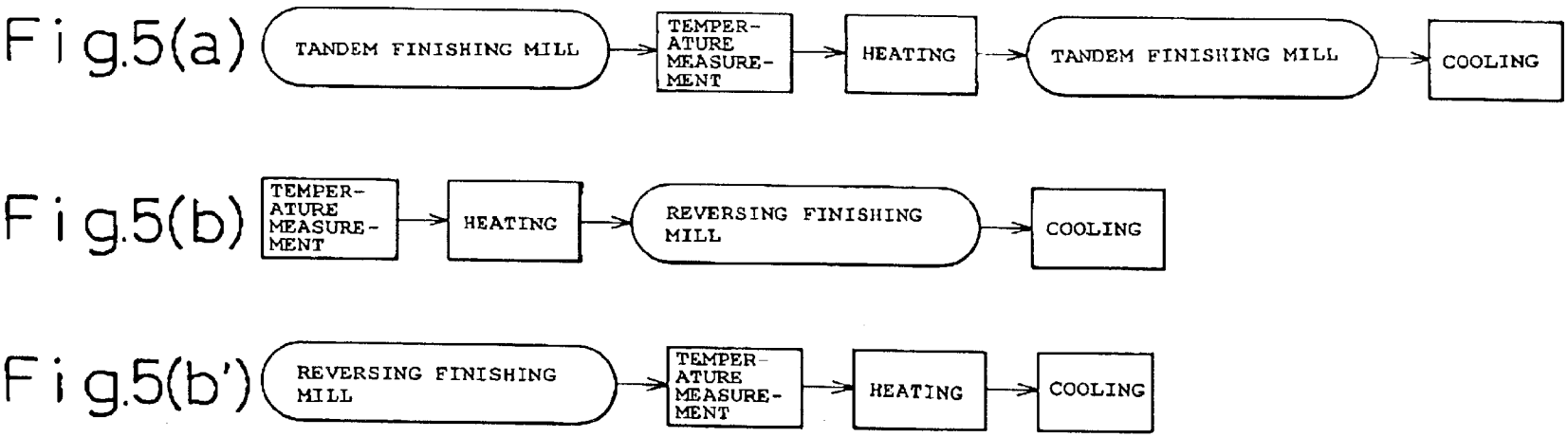
FIGS. 5(*a*), 5(*b*) and 5(*b'*) are diagrams showing the outlines of the processes according to the present invention to control the flatness between two finishing mill stands.

Hot-rolled strips having good flatness and free from edge waves after unwinding can be produced according to the present invention by rolling them on a tandem finishing mill, cooing them using the ROT cooling and coiling them thereafter (see FIGS. 5(*a*) and 6(*a*)). In the case, especially, of metal strip rolling, the strip travelling time from a finishing mill stand to the subsequent finishing mill stand is 0.5 to 1 sec., the same from the final finish rolling to the beginning of the cooling is 0.5 to 3 sec. And the strips are coiled under tension. For this reason, at high temperatures, the metal material creeps under the tension so as to decrease the stress distribution in the transverse section of the strips, and thus residual stress created during the rolling is removed and the edge waves and center buckles of the strips are already straightened. As a consequence, the temperature difference during these processes remains and appears as residual stress when the strips are cooled to the room temperature, and the larger the temperature difference, the larger the residual stress, resulting in poor flatness. A highly accurate temperature control can be obtained by measuring the surface temperature of a metal sheet or plate before edge heating. To obtain a more accurately controlled shape, it is preferable to install a temperature measurement apparatus immediately before an edge heater. It is desirable to measure a temperature distribution across the strip width using a thermo-viewer or the like, otherwise, if this is impossible, to measure the temperature at three points, at the center and at 5 to 20 mm from the both edges. If an edge measuring point is less than 5 mm from an edge, the measurement will not be accurate and, if it is more than 20 mm from the edge, the measurement obtained will not represent the real condition of the edge portion.

When heavy gauge steel plates are produced according to the present invention, a reversing mill is used instead of a tandem finishing mill, and the plates are finish-rolled after heating the edges and/or the center or all the width at the entry to and/or the exit from the reversing mill. In this case, even when hot leveling is subsequently applied without being accompanied by any other conditioning processes, plates having a better shape than in the case of no edge heating can be obtained. Although it is possible to obtain a good shape by applying so-called controlled cooling (water cooling) and, optionally, hot leveling before or after the controlled cooling, it is better to conduct both the controlled cooling and the hot leveling. The processes according to the present invention are schematically shown in FIGS. 5(*b*), 5(*b'*), 6(*a*), 6(*d*), 6(*e*) and 6(*g*).

According to the present invention, furthermore, the plates undergo edge heating and/or center heating after hot leveling. When the plates are subjected only to edge heating; or center heating and then left to cool naturally, their shape is better than the case that neither the edge heating nor the center heating is applied. FIG. 5(*c*) shows an outline of the processes according to the present invention.

It is preferable that the apparatus to heat the edge portions and/or the center portion is any one of an induction heater, a laser irradiation heater, a plasma irradiation heater and a gas combustion heater.

According to the present invention, moreover, a metal sheet or plate having a good shape is obtained by estimating the strain difference at the room temperature between the center portion and the edge portions caused by the elongation strain difference and thermal strain difference before cooling between said portions and by minimizing the estimated strain difference through reducing the temperature difference between said portions to ±50° C. or less. It is preferable to reduce the temperature difference to ±25° C. or less, more preferably to ±15° C. or less or, ideally, to ±5° C. or less. It is desirable to make the temperature distribution of a metal sheet or plate across its width as even as possible. Since it is essential to reduce the strain difference at the room temperature between a center portion and edge portions caused by the elongation strain difference and the thermal strain difference between said portions, it does not matter if the edge portions become hotter than the center portion.

The transverse temperature distribution of a steel sheet or plate having undergone edge heating and/or center heating is made homogeneous even after a controlled cooling and, therefore, the steel sheet or plate having an excellent shape after cooling is obtained, and the product does not require cold leveling or other shape correction measures. The residual stress of a steel sheet or plate is decreased during processing at a hot leveler. However, since the hot leveler and its leveling rolls are directly cooled with a water jet or spray to prevent roll sticking and other equipment damage by the heat of the metal sheet or plate, the metal material will also be cooled during the leveling operation. In this process, the edge portions are cooled more than the other portions, creating a temperature difference between the edge portions and the center portion. If a metal sheet or plate is cooled in this condition, residual thermal strain is created corresponding to the temperature difference end, when cooled down to the room temperature, a thermal stress is created corresponding to the strain and, where this thermal stress exceeds the buckling limit of the material, it becomes apparent as waviness. The heating is conducted after the hot leveling for the purpose of minimizing the temperature difference. The processes according to the present invention are outlined in FIG. 6(*f*).

Further, according to the present invention, it is possible to produce a steel sheet or plate having an excellent shape by heating the edge portions and/or the center portion, applying controlled cooling and/or hot leveling and then leaving the product to cool naturally. In this case, the shape of the sheet or plate after cooling is better than in the case of no edge heating or center heating. The processes according to the present invention are outlined in FIGS. 6(*b*), 6(*d*), 6(*e*) and 6(*g*).

Figures 6A, 6B, 6C, 6D, 6E, 6F, 6G:
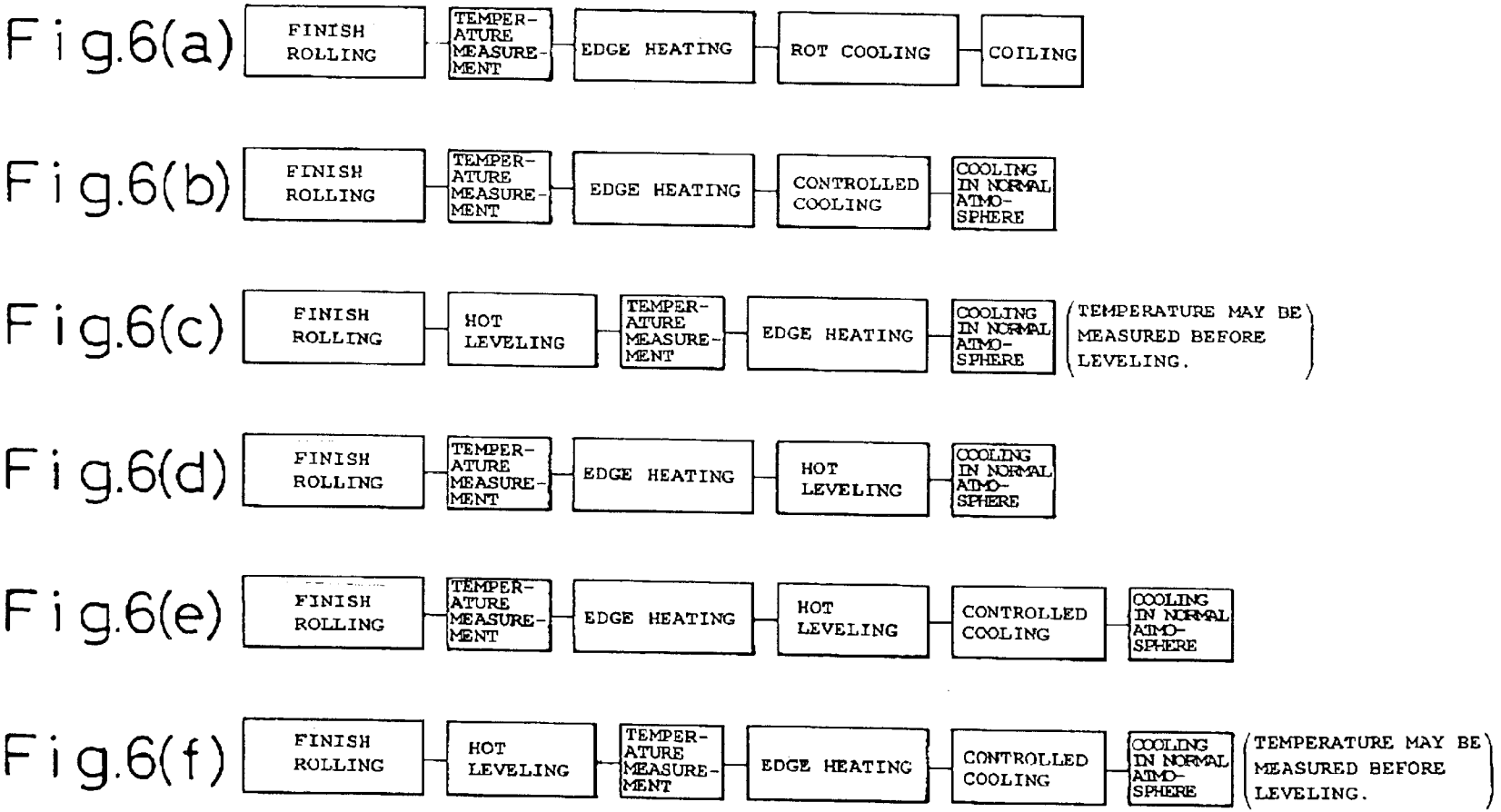
FIGS. 6(*a*), 6(*b*), 6(*c*), 6(*d*), 6(*e*), 6(*f*) and 6(*g*) are diagrams showing the outlines of the processes according to the present invention to control the flatness after completing the finish rolling.

The temperature of a metal sheet or plate is controlled more accurately according to the present invention by measuring its surface temperature after completing the hot rolling and before heating the edge portions and/or the center portion (see FIGS. 6(*a*) to 6(*g*)). Note that, although FIGS. 6(*c*) and 6(*f*) show that the temperature measurement is done after the leveling, it may be done between the rolling and the leveling. The surface temperature may be measured at any position from the hot finishing mill to the edge heater and/or the center portion heater, but it is preferable for obtaining a better controlled shape of the sheet or plate to install a temperature measurement device immediately before the edge heater. It is desirable to measure the temperature distribution across the strip width using a thermoviewe or the like, otherwise, if this is impossible, measure the temperature at three points, the center and 5 to 20 mm from the both edges. If an edge measuring point is less than 5 mm from an edge, the measurement will not be accurate and, if it is more than 20 mm from the edge, the measurement obtained will not represent the real condition of the edge portion.

As a special feature of the present invention, the production processes can be simplified, since it provides that the edges of a sheet or plate can be trimmed by heating the edges using a laser irradiation heater. The edge portions where the thickness is reduced to below a permissible range in strip rolling, the phenomenon being called edge drop, can be trimmed off during the heating by controlling the laser output to a high level.

Because the present invention provides that a metal material is transferred while being held by one or more pairs of upper and lower pinch rolls after its leading end has come out of a hot finishing mill, it is also possible to prevent the occurrence of abnormal strip behavior such as flying, waving and the like during strip transfer on the run out table.

An ROT cooling zone is usually about 100 to 200 m long, and a strip runs a distance of tens of meters on the ROT under no tension until its leading end reaches a coiler and is wound on its mandrel to receive the tension. Thus, the strip shape is not corrected during the no-tension period. In such a condition, not only the temperature difference but also the residual stress at the exit from the rolling mill and change in the strip shape may disturb flatness. Another problem in this production stage is that, while the strip is driven by the rolling rolls of the mill towards the coiler and transferred on the ROT by the friction of its rollers, it is not held firmly at the leading end and, therefore, the leading end may hit and damage production facilities as a result of flying or waving. It is also possible that an unstable strip movement makes it difficult to input an exact amount of heat precisely to desired portions. These problems are solved with a pair or more of pinch rolls installed between the rolling mill and the ROT to stabilize the travelling behavior of the strip and impose a tension comparable to a coiling tension.

EXAMPLE 1

A heater 6 for heating edge and center portions was newly installed between two stands of a tandem finishing mill 1 of an existing production line, as shown in FIG. 1, as the means for heating the edge portions and the center portion, for the purpose of homogenizing the transverse temperature distribution of steel strips before they enter an ROT cooling apparatus 3. The strip surface temperature was measured at the strip width center and 20 mm from the edges with a radiation pyrometer 5 installed between two stands of the tandem finishing mill and immediately before the heater for the edge and center portions.

The heating means for the edge portions and the center portion heated the portions 10 mm from the both edges of steel strips 7 passing between two stands of the tandem finishing mill 1 using a $CO_2$ laser heater 6. The heating was commenced immediately after a tension was established on the strip between the two mill stands 1. As a result, the number of the coils having the edge waves and center buckles of the steepness of 1.5% among 1,000 coils was zero. The flying/waving height of the strips between the two finishing mill stands 1 was controlled to 5 mm, which fact eliminated adverse effects on the heating operation and apparatus.

With comparative examples, which were rolled without a heater for the edge and center portions 6, the number of the coils having the edge waves of the steepness of 1.5% among 1,000 coils was 350 and that of the coils having the center buckles of he steepness of 1.5% among the same number of coils was 10.

EXAMPLE 2

An edge heater 6 was newly installed at the exit from a finishing mill 1 of an existing production line, as shown in FIG. 2, as the means for heating edges, for the purpose of homogenizing the transverse temperature distribution of steel strips before ROT cooling. The means for heating the edge portions heated the portions 10 mm from the both edges of the steel strips 7 using a $CO_2$ laser heater 6. The heating was commenced immediately after the leading end of steel strip 7 coming out from the finishing mill 1 went through a pinch roll unit 8 and a tension was established upon the strip by two pairs of pinch rolls to suppress flying and waving of the strips. The use of the laser for the heating allowed cutting of the strips under a condition of 45 kW of heat input and. 0.5 m/sec. of strip travelling speed. Under said condition, it was possible to trim off the strip portions not satisfying a prescribed product thickness owing to the edge drop.

The number of the coils having the edge waves and center buckles of the steepness of 1.5% among 1,000 coils was zero. The flying/waving height of the strips between the two pinch roll stands was controlled to 5 mm, which fact eliminated adverse effects on the heating operation and apparatus.

With comparative examples, which were rolled without a heater for the edge portions 6, the number of the coils having the edge waves of the steepness of 1.5% among 1,000 coils was 350 and that of the coils having the center buckles of the steepness of 1.5% among the same number of coils was 10.

INDUSTRIAL APPLICABILITY

Since the production method according to the present invention improves cold flatness of a hot-rolled metal strip, a post-treatment for improving strip flatness by a skin pass mill can be eliminated. Additionally, the treatment time at a subsequent processing step can be reduced, since the present invention can suppress walking and jumping of strips caused by poor flatness during the processing. Further, when the strip heating according to the present invention is applied also for the purpose of edge trimming, final products ready for shipment can be obtained at a hot rolling process without any additional treatment, and a significant cost reduction is realized.

What is claimed is:

1. A method for controlling flatness of a metal sheet or plate comprising the following steps;

(a) measuring surface temperatures of the metal sheet or plate at edge portions and a center portion across a width of the metal sheet or plate after one or more rolling passes at a tandem or reversing finishing mill, (b) controlling heating temperatures of the edge portions and/or the center portion based on the measured surface temperatures, and then (c) water-cooling and/or hot-leveling the metal sheet or plate, whereby the heating temperatures of the edge portions of the steel sheet or plate are controlled so that the surface temperature of each edge portion measured in a range of 50 to 200 mm from each edge as the edge portion, and that of the center portion thereof, become within ±50° C. of each other.

2. A method for controlling flatness of a metal sheet or plate comprising the following steps:

(a) measuring surface temperatures of the metal sheet or plate at edge portions and a center portion across a width of the metal sheet or plate at an exit of a tandem or reversing finishing mill, (b) controlling heating temperatures of the edge portions and/or the center portion based on the measured surface temperatures, and then, (c) water-cooling and/or hot-leveling the metal sheet or plate, whereby the heating temperatures of the edge portions of the steel sheet or plate are controlled so that the surface temperature of each edge portion measured in a range of 50 to 200 mm from each edge as the edge portion, and that of the center portion thereof, becomes within ±50° C. of each other.

3. A method for controlling the flatness of a metal sheet or plate according to claim 1 or 2, wherein a temperature difference between the edge portion and the center portion is ±10° C.

4. A method for controlling the flatness of a metal sheet or plate according to any one of claims 1 to 3, wherein heating is carried out by at least one of an induction heater, a plasma irradiation heater or a gas combustion heater.

5. A method for controlling the flatness of a metal sheet or plate according to any one of claims 1 to 3, wherein hot-leveling the metal sheet or plate is carried out before or after the temperature measuring in finishing rolling by a reversing finishing mill, and then cooling naturally in normal atmosphere.

6. A method for controlling the flatness of a metal sheet or plate according to any one of claims 1 to 3, wherein hot-leveling the metal sheet or plate is carried out before or after the temperature measuring in finishing rolling by a reversing finishing mill, and then forced cooling is carried out by water followed by cooling naturally in normal atmosphere.

7. A method for controlling the flatness of a metal sheet or plate according to any one of claims 1 to 3, wherein hot-leveling the metal sheet or plate is carried out after heating in finishing rolling by a reversing finishing mill, and then forced cooling is carried out by water followed by cooling naturally in normal atmosphere.

8. A method for controlling flatness of a metal sheet or plate comprising the following steps:

(a) measuring surface temperatures of the metal sheet or plate at edge portions and a center portion across a width of the metal sheet or plate after one or more rolling passes at a reversing finishing mill, (b) controlling heating temperatures of the edge portions and/or the center portion based on the measured surface temperatures, and then (c) water-cooling and/or hot-leveling the metal sheet or plate, whereby the heating temperatures of the edge portions of the steel sheet or plate are controlled so that the surface temperature of each edge portion measured in the range of 50 to 200 mm from each edge as the edge portion, and that of the center portion thereof, become within ±50° C. of each other.

9. A method for controlling the flatness of a metal sheet or plate according to claim 8, wherein a temperature difference between the edge portion and the center portion is ±10° C.

* * * * *